US008408279B2

(12) United States Patent
Eichholz et al.

(10) Patent No.: US 8,408,279 B2
(45) Date of Patent: Apr. 2, 2013

(54) CASTING NOZZLE FOR A HORIZONTAL CONTINUOUS CASTING SYSTEM

(75) Inventors: Hellfried Eichholz, Ilsede (DE); Sven Klawiter, Sarstedt (DE); Rune Schmidt-Jürgensen, Hannover (DE); Karl-Heinz Spitzer, Clausthal (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 0 days.

(21) Appl. No.: 13/255,594

(22) PCT Filed: Feb. 15, 2010

(86) PCT No.: PCT/DE2010/000213

§ 371 (c)(1),
(2), (4) Date: Nov. 18, 2011

(87) PCT Pub. No.: WO2010/102599

PCT Pub. Date: Sep. 16, 2010

(65) Prior Publication Data

US 2012/0132389 A1 May 31, 2012

(30) Foreign Application Priority Data

Mar. 12, 2009 (DE) ..... 10 2009 012 984

(51) Int. Cl.
*B22D 11/06* (2006.01)
*B22D 11/103* (2006.01)

(52) U.S. Cl. ..... 164/429; 164/437

(58) Field of Classification Search ..... 164/479–482, 164/429–434, 488–490, 437–440
See application file for complete search history.

(56) References Cited

U.S. PATENT DOCUMENTS

| | | | | |
|---|---|---|---|---|
| 4,593,742 | A * | 6/1986 | Hazelett et al. | 164/415 |
| 5,804,136 | A * | 9/1998 | Kagan | 266/230 |
| 6,173,755 | B1 | 1/2001 | Li et al. | |
| 2002/0084056 | A1 | 7/2002 | Hoffmann et al. | |
| 2006/0191664 | A1 * | 8/2006 | Sulzer et al. | 164/481 |

FOREIGN PATENT DOCUMENTS

| | | |
|---|---|---|
| DE | 102005062854 | 7/2007 |
| EP | 0 258 469 | 3/1988 |
| JP | 59-125244 | 7/1984 |

OTHER PUBLICATIONS

Karl-Heinz Spitzer et al.: "Direct Strip Casting (DSC)—an Option for the Production of New Steel Grades", in: steel research, vol. 74, No. 11/12; 2003.

Roderick I.L. Guthrie et al.: "The Design of Continuous Casting Processes for Steel", in: Handbook for Metallurgical Process Design, Jan. 1, 2004, pp. 251-293.

* cited by examiner

*Primary Examiner* — Kuang Lin
(74) *Attorney, Agent, or Firm* — Henry M Feiereisen LLC

(57) ABSTRACT

The invention relates to a casting nozzle for a horizontal strip casting system, in particular for casting steel strip, wherein the nozzle is designed as a narrow rectangular hollow block having a bottom, top and two side walls and made of refractory material, the outflow region being located only slightly above a cooled continuous belt receiving the outflowing melt. Viewed in the flow direction, it is provided that the clear cross-section of the hollow block in the outflow region reduces uniformly in the direction toward the outflow and the end face of the bottom of the hollow block is designed with respect to the surface of the continuous belt such that the melt contacts the continuous belt perpendicularly.

23 Claims, 3 Drawing Sheets

CASTING NOZZLE FOR A HORIZONTAL CONTINUOUS CASTING SYSTEM

CROSS-REFERENCES TO RELATED APPLICATIONS

This application is the U.S. National Stage of International Application No. PCT/DE2010/000213, filed Feb. 15, 2010, which designated the United States and has been published as International Publication No. WO 2010/102599 A1 and which claims the priority of German Patent Application, Serial No. 10 2009 012 984.7, filed Mar. 12, 2009, pursuant to 35 U.S.C. 119(a)-(d).

BACKGROUND OF THE INVENTION

The invention relates to a casting nozzle for a horizontal strip casting facility, in particular for casting steel strip. Such casting facilities require liquid steel to be applied upon a cooled continuous belt from the nozzle which forms a casting channel.

Such a casting nozzle is known from "Direct Strip Casting" (DSC)—an Option for the Production of New Steel Grades"—steel research 74 (2003) No. 11/12 p. 724-731.

In this known arrangement, liquid steel flows from a distributor via a horizontally aligned feed channel into the casting nozzle which has in cross section a narrow rectangular channel surrounded by refractory material and configured as hollow block with bottom, top, and two side walls.

A web made of refractory material is arranged in the outflow region, as viewed in flow direction, first on the upper side and then on the underside of the casting nozzle channel transversely to the flow direction, and extends into the channel. Both webs form a weir in order to keep back possible small slurry residues and oxides in the melt to act in a manner of a siphon. The transfer of the liquid steel onto the cooled continuous belt is implemented in sliding manner along a slant in the outflow region.

As a result of surface tension and mass flow, the steel stream undergoes a contraction in the outflow region of the casting nozzle. This effect causes an irregular distribution of the melt in transverse direction on the continuous belt and thus to inadequate edge fill of the cast steel strip.

SUMMARY OF THE INVENTION

It is an object of the invention to so improve the known casting nozzle as to attain a more even distribution of the melt also in transverse direction, when contacting the continuous belt.

In accordance with the invention, this object is solved by a casting nozzle for a horizontal strip casting facility, in particular for casting of steel strip, with the casting nozzle configured as a narrow rectangular hollow block which is made from refractory material and has a bottom, top, and two side walls and which has an outflow region located only slightly above a cooled continuous belt which receives the outflowing melt, wherein the clear cross section of the hollow block, as viewed in flow direction, decreases in the outflow region uniformly in direction of the outflow, and the end face of the bottom is constructed towards the surface of the continuous belt in such a manner that the melt contacts the continuous belt perpendicularly. For that purpose, the end face of the bottom may be configured perpendicular or be provided with an undercut. Advantageous refinements are the subject matter of sub-claims.

The slanted profile results in a reduction of the clear cross section of the hollow block to a minimum value that still ensures the necessary throughput at the outflow and causes a backup of melt which pushes the melt stream in opposition to the action of the surface tension also to the marginal zones.

The cross sectional reduction is realized preferably by a decrease of the clear vertical distance. An ascent of the bottom in relation to the top has been proven as a beneficial variation.

The reduction in distance can be realized in a particularly simple manner when implemented linear. The desired effect can easily be realized when the surface of the bottom ascends linearly up to the outflow edge, as viewed in flow direction.

The hollow block may be made of one piece or of multiple parts from separate elements. When multiple parts are involved, the hollow block may be made of separate bottom element with a single-part hood comprised of top and two side walls or of a separate top element, a separate bottom element and two separate side elements.

For the sake of simplicity, only the bottom element is provided with the slanted run-on surface according to the invention. This has the advantage of a simple exchange in the event the bottom element should wear off faster than the top element or the side elements.

Also the rectangular or undercut arrangement of the end face of the bottom element of the casting nozzle in relation to the surface of the continuous belt results in a better melt distribution upon the continuous belt. The outflowing melt thus contacts the continuous belt nearly perpendicular and generates an additional transverse momentum. The height from the outflow edge to the continuous belt should hereby amount to preferably 30 mm.

Preferably, the ascent of the slanted run-on surface of the bottom element is linear, resembling a ramp. The extent of the ascent in flow direction should amount to at least 30 mm, preferably at >50 mm.

In order to be able to influence the outflowing melt early on in terms of a uniform distribution in transverse direction, for example by gas jets or inductors, it is helpful to extend the bottom element, as viewed in flow direction, beyond the top element. This overhang should be at least 10 mm. Such an overhang permits manipulation of the outflowing melt already in the region of the casting nozzle instead of only on the continuous belt.

It is proposed for this case to provide the marginal zones of the overhang of the bottom element with descending slanted surfaces, respectively, as viewed in flow direction. As a result, the melt stream, as viewed in transverse direction, is deflected to the marginal zones to also promote a better distribution of the melt.

To facilitate production of the separate bottom element, it is of advantage to provide the outflow edge with a chamfer. This chamfer reduces wear of the highly strained outflow edge at the same time.

BRIEF DESCRIPTION OF THE DRAWING

An exemplary embodiment of the casting nozzle according to the invention is described in greater detail.

It is shown in.

DETAILED DESCRIPTION OF PREFERRED EMBODIMENTS

Figure 1:
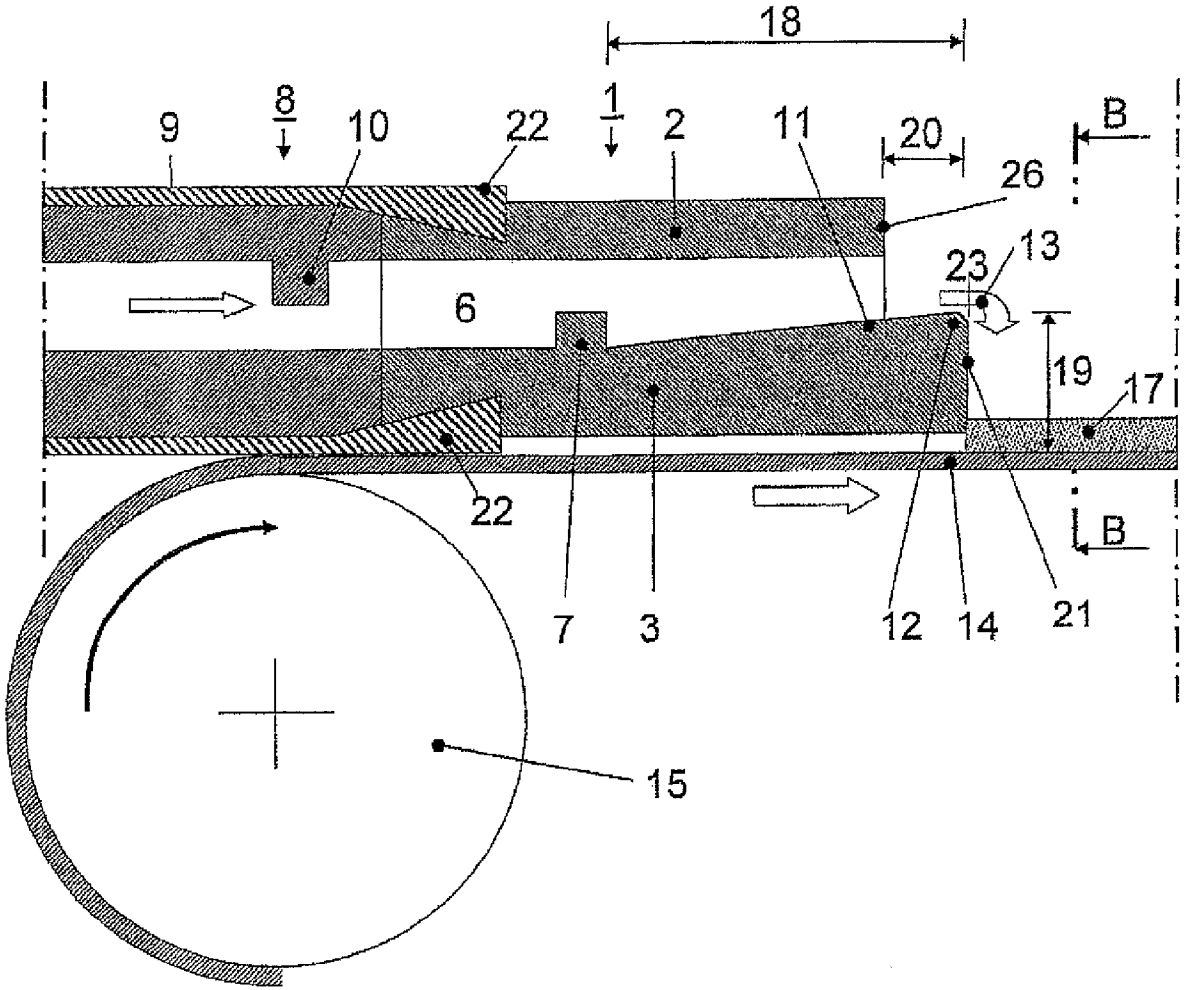
FIG. 1 a longitudinal section along the line A-A in FIG. 2.
Figure 2:
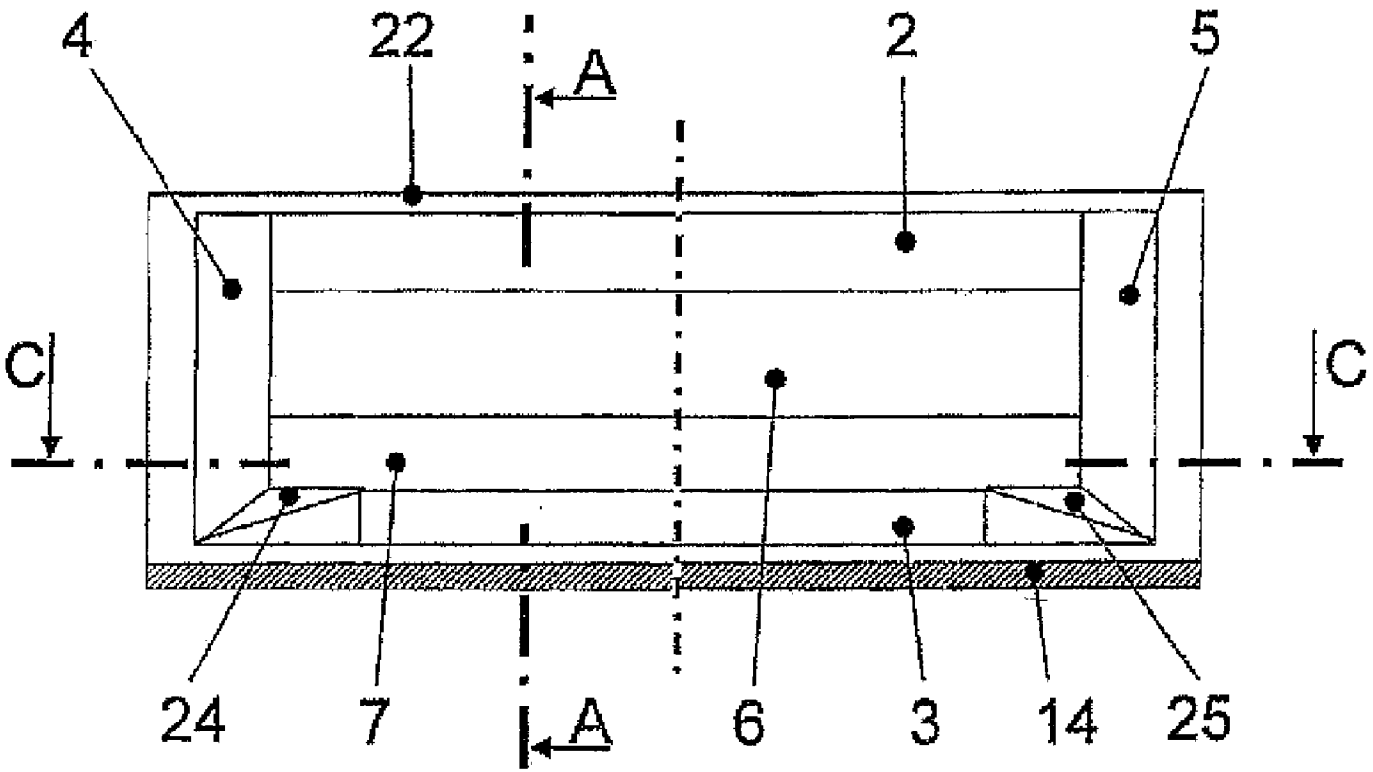
FIG. 2 a cross section along the line B-B in FIG. 1.

FIG. 1 shows by way of a longitudinal section and FIG. 2 by way of a cross section schematically an embodiment of the casting nozzle 2 according to the invention. It is configured as narrow rectangular hollow block and is comprised in this exemplary embodiment of a top element 2, a bottom element 3, and two side elements 4, 5 (FIG. 2). All mentioned parts 2-5 are made of refractory material, preferably ceramics, and form a horizontal rectangular channel 6.

As is known in the state of the art, the bottom element 3 includes a web which projects into the channel 6 and extends transversely to the flow direction and which forms a so-called lower weir 7.

Placed upstream of the casting nozzle 1 is a feed channel 8 which is connected to a distributor, not shown here.

In the shown embodiment, a web projects at the top element 9 of the feed channel 8 into the clear cross section and extends transversely to the flow direction to form a so-called upper weir 10. Both weirs 7, 10 interact together like a siphon and should, if need be, keep back slurry residue and oxides left in the melt.

Both weirs 7, 10 may be arranged in the casting nozzle 1 and in the feed channel 8, or, as shown here, the upper weir 10 in the feed channel 8 and the lower weir 7 in the casting nozzle 1.

The feed channel 8 is surrounded by a frame 22 of metal which has an end configured in the form of a tongue to be able to clamp the adjacent casting nozzle 1.

In accordance with the invention, the surface of the bottom 3 has a slanted run-on surface 11 having a linear ascent and extending up to the outflow edge 12. In order for the outflowing melt 13 to contact the continuous belt substantially perpendicular, the outflow, unlike the state of the art, is not provided with a slant but the end face 21 of the bottom element 3 extends at a right angle in relation to the surface of the continuous belt 14.

Illustration of the type of cooling of the continuous belt 14 is omitted here. Only the front deflection roller 15 of the revolving belt and the two side boundaries 16, 17 of the continuous belt 14 are depicted.

The slanted run-on surface 11 has an extent 18, as viewed in flow direction, of at least 30 mm, preferably >50 mm.

In this exemplary embodiment, the start of the slanted run-on surface 11 is provided in immediate proximity of the lower weir 7. To reduce wear of the slanted run-of surface 12, the latter is provided with a chamfer 23. To generate a certain transverse momentum onto the melt, the height 19 from the lower edge of the chamfer 23 to the surface of the continuous belt 14 is preferably 30 mm.

In order to be able to manipulate early on the melt outflowing from the casting nozzle in terms of attaining a uniform distribution in transverse direction, the end face 21 of the bottom element 3 has an overhang 20 in relation to the end face 26 of the top element 2.

Figure 3:
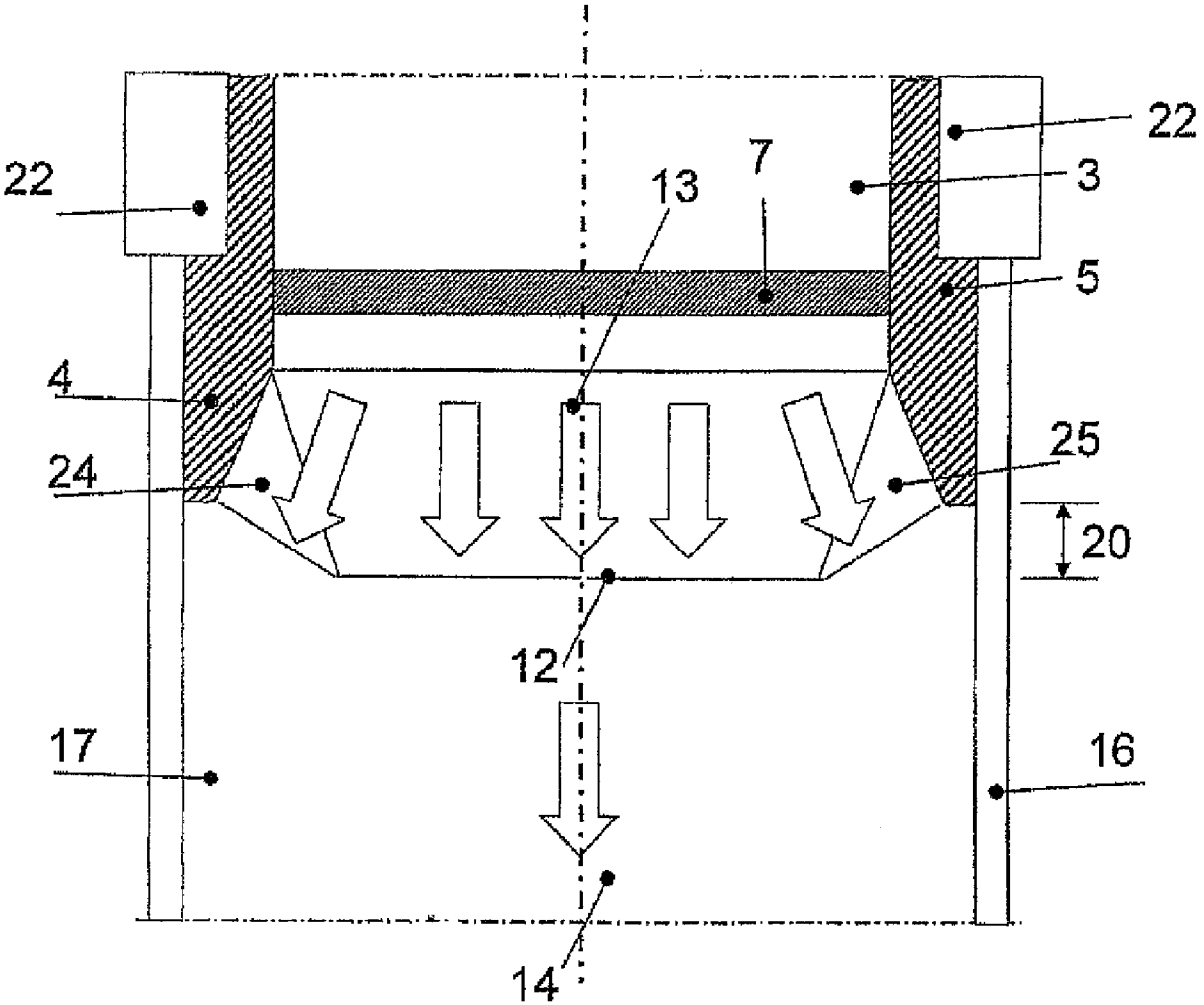
FIG. 3 a section along the line C-C in FIG. 2.

FIG. 3 shows by way of a section C-C of FIG. 2 a further measure to more evenly distribute the outflowing melt 13 in transverse direction onto the continuous belt 14. For that purpose, the bottom element 3 has in both marginal zones of the overhang a slanted surface 24, 25 which descends in flow direction.

As a result, parts of the outflowing melt 13 is deflected in the marginal zones and accelerated, as indicated by the depicted arrows.

In projection, each of the slanted surfaces 24, 25 defines a triangle defined by a first corner being formed by the start of the slanted run-on surface 11, a second corner being formed by the outflow edge 12, and a third corner being formed by the end face of the respective side element 4, 5.

The illustration in FIG. 3 also shows the extent of projection of the bottom element 3 beyond the top element 2. This overhang 20 should amount to at least 10 mm in order to be able to influence the outflowing melt early on.

The invention claimed is:

1. A casting nozzle for a horizontal strip casting facility having a cooled continuous belt, said casting nozzle comprising a rectangular hollow block which is defined by a bottom, top, and two side elements and is made from refractory material, said hollow block having an outflow region terminating in an outflow for feeding melt onto a continuous belt, said hollow block defined by a clear cross section which, as viewed in flow direction of the melt decreases in the outflow region uniformly, wherein the bottom of the hollow block has an end face configured to enable melt to contact the continuous belt perpendicularly, wherein the bottom ascends in relation to the top.

2. The casting nozzle of claim 1, wherein the end face of the bottom of the hollow block is configured perpendicular to the surface of the continuous belt.

3. The casting nozzle of claim 1, wherein the end face of the bottom of the hollow block has an undercut towards the surface of the continuous belt.

4. The casting nozzle of claim 1, wherein the outflow region of the hollow block is defined by a vertical distance which decreases towards the outflow.

5. The casting nozzle of claim 4, wherein the decrease in the vertical distance is established gradually.

6. The casting nozzle of claim 1, wherein the ascent of the bottom is established gradually.

7. The casting nozzle of claim 1, wherein the bottom is configured as separate bottom element, with the top and the two side elements being configured as singe-piece rectangular hood, said bottom element having an inner surface which ascends in the outflow region linearly to an edge of the outflow, as viewed in the flow direction.

8. The casting nozzle of claim 1, wherein the bottom, the two separate side elements and the top are separate components, said bottom having a surface which ascends in the outflow region linearly to an edge of the outflow, as viewed in the flow direction.

9. The casting nozzle of claim 7, wherein the inner surface of the bottom element forms a slanted run-on surface of a length of at least 30 mm in the flow direction.

10. The casting nozzle of claim 7, wherein the inner surface of the bottom element forms a slanted run-on surface of a length of >50 mm in the flow direction.

11. The casting nozzle of claim 8, wherein the surface of the bottom forms a slanted run-on surface of a length of at least 30 mm in the flow direction.

12. The casting nozzle of claim 8, wherein the surface of the bottom forms a slanted run-on surface of a length of >50 mm in the flow direction.

13. The casting nozzle of claim 1, wherein the bottom is sized to extend with its end face beyond an end face of the top to define an overhang, as viewed in the flow direction.

14. The casting nozzle of claim 13, wherein the overhang has a length of 10 mm.

15. The casting nozzle of claim 1, wherein the bottom has opposite marginal zones, each of the marginal zones having in an area of the outflow a slanted surface which descends as viewed in the flow direction.

16. The casting nozzle of claim 7, wherein the bottom element has opposite marginal zones, each of the marginal zones having in an area of the outflow a slanted surface which descends as viewed in the flow direction, said slanted surface defining in projection a triangle defined by a first corner being formed by a start of the slanted run-on surface, a second corner being formed by the outflow edge, and a third corner being formed by an end face of an associated one of the side elements.

17. The casting nozzle of claim 8, wherein the bottom has opposite marginal zones, each of the marginal zones having in an area of the outflow a slanted surface which descends as viewed in the flow direction, said slanted surface defining in projection a triangle defined by a first corner being formed by a start of the slanted run-on surface, a second corner being formed by the outflow edge, and a third corner being formed by an end face of an associated one of the side elements.

18. The casting nozzle of claim 7, wherein the outflow edge has a chamfer.

19. The casting nozzle of claim 18, wherein a distance from a lower edge of the chamfer to the surface of the continuous belt is 30 mm.

20. The casting nozzle of claim 8, wherein the outflow edge has a chamfer.

21. The casting nozzle of claim 20, wherein a distance from a lower edge of the chamfer to the surface of the continuous belt is 30 mm.

22. A casting nozzle for a horizontal strip casting facility having a cooled continuous belt, said casting nozzle comprising a rectangular hollow block which is defined by a bottom, top, and two side elements and is made from refractory material, said hollow block having an outflow region terminating in an outflow for feeding melt onto a continuous belt, said hollow block defined by a clear cross section which, as viewed in flow direction of the melt decreases in the outflow region uniformly, wherein the bottom of the hollow block has an end face configured to enable melt to contact the continuous belt perpendicularly, wherein the bottom is configured as separate bottom element, with the top and the two side elements being configured as singe-piece rectangular hood, said bottom element having an inner surface which ascends in the outflow region linearly to an edge of the outflow, as viewed in the flow direction.

23. A casting nozzle for a horizontal strip casting facility having a cooled continuous belt, said casting nozzle comprising a rectangular hollow block which is defined by a bottom, top, and two side elements and is made from refractory material, said hollow block having an outflow region terminating in an outflow for feeding melt onto a continuous belt, said hollow block defined by a clear cross section which, as viewed in flow direction of the melt decreases in the outflow region uniformly, wherein the bottom of the hollow block has an end face configured to enable melt to contact the continuous belt perpendicularly, wherein the bottom, the two separate side elements and the top are separate components, said bottom having a surface which ascends in the outflow region linearly to an edge of the outflow, as viewed in the flow direction.

* * * * *